US008641439B2

(12) United States Patent
Tateishi et al.

(10) Patent No.: US 8,641,439 B2
(45) Date of Patent: Feb. 4, 2014

(54) ELECTRICAL CONNECTOR

(75) Inventors: Jin Tateishi, Machida (JP); Yoshinobu Shimada, Machida (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 0 days.

(21) Appl. No.: 13/585,373

(22) Filed: Aug. 14, 2012

(65) Prior Publication Data

US 2013/0059476 A1 Mar. 7, 2013

(30) Foreign Application Priority Data

Sep. 2, 2011 (JP) ..... 2011-191585

(51) Int. Cl.
*H01R 13/15* (2006.01)
*H01R 13/62* (2006.01)

(52) U.S. Cl.
USPC ..... 439/260; 439/495

(58) Field of Classification Search
USPC ..... 439/626, 260, 261, 495, 629, 350
See application file for complete search history.

(56) References Cited

U.S. PATENT DOCUMENTS 6,726,497 B2 * 4/2004 Nogawa et al. ..... 439/260
7,347,720 B2 * 3/2008 Takashita ..... 439/495
7,452,227 B2 * 11/2008 Matoba et al. ..... 439/260
7,530,831 B2 * 5/2009 Nishimatsu et al. ..... 439/260
7,931,491 B2 * 4/2011 Takahashi et al. ..... 439/495
8,267,709 B2 * 9/2012 Taketomi ..... 439/329
2006/0172590 A1 * 8/2006 Yamada et al. ..... 439/495
2007/0032115 A1 * 2/2007 Takashita ..... 439/260

FOREIGN PATENT DOCUMENTS

JP 2008-4404 1/2008
JP 2008-192408 8/2008
JP 2008-300373 12/2008

* cited by examiner

*Primary Examiner* — Hae Moon Hyeon
(74) *Attorney, Agent, or Firm* — Oblon, Spivak, McClelland, Maier & Neustadt, L.L.P.

(57) ABSTRACT

A simple structure capable of preventing a cam part of an actuator from coming out of position when the actuator is in an open position. The cam part 12*a* of the actuator 12 for rotating contacts 13 mounted inside an insulating housing 11 is provided with an engaging surface 12*a*2 which is a flat surface that faces cam lock protrusions 13*a*2 of second contact beams 13*a* when the actuator 12 is in the open position. Upon an external force or the like acting on the cam part 12*a* to come out of cam rotation recesses 13*b*3 when the actuator 12 is in the open position, the engaging surface 12*a*2 of the cam part 12*a* abuts on and makes locking engagement with the cam lock protrusions 13*a*2, so that the actuator 12 is prevented from coming out of position.

3 Claims, 9 Drawing Sheets

ELECTRICAL CONNECTOR

BACKGROUND OF THE INVENTION

1. Field of the Invention

The present invention relates to an electrical connector configured to secure a signal transmission medium by moving an actuator.

2. Description of the Related Art

Commonly, various electrical connectors are widely used as a means of electrically connecting various signal transmission media such as flexible printed circuit (FPC) or flexible flat cables (FFC) in various electrical devices and the like. An electrical connector disclosed in Patent Document 1 and others listed below, for example, which is used as mounted on a printed wiring board, is configured to receive a signal transmission medium such as FPC or FFC inserted thereinto from an opening at the front end of an insulating housing (insulator). An actuator (connection operator) is held in an "open position" where it releases the signal transmission medium when the medium is inserted therein. The actuator is pivoted by a force exerted by an operator toward a "closed position" on the front or the back of the connector, for example by being pushed down.

When the actuator (connection operator) is pivoted to the "closed position" where it sandwiches the signal transmission medium, a cam part provided to the actuator presses one end of conductive contacts, whereby the other end of the conductive contacts is moved to make pressure contact with the signal transmission medium (such as FPC or FFC) to securely hold the same. When the actuator in this "closed position" is pivoted back to the original "open position" by, for example, being pulled up, the conductive contacts move by their own resilient restorative force to separate from the signal transmission medium (such as FPC or FFC), so that the signal transmission medium is released.

The cam part that causes the resilient movement of the conductive contacts is formed by a component having a substantially elliptical cross-sectional shape. It is configured to be rotatably accommodated in cam rotation recesses formed in stationary beams of the conductive contacts, and rotated between the stationary beams and movable beams with changing diameter. Corresponding to this cam part, the movable beams have a cam lock protrusion at one end to face the cam part in a direction in which the signal transmission medium is inserted, so that when the cam part attempts to come out of the cam rotation recesses because of an external force applied to the actuator, part of the cam part abuts on the cam lock protrusions, so that it is locked and does not come out of the connector.

However, the contact pressure of the cam part on the conductive contacts is small when the actuator is in the "open position", in particular, as the cam part having a substantially elliptical cross-sectional shape lies on its side, because of which the cam rotation recesses hold the cam part less firmly, and also, the cam lock protrusions lock the cam part less reliably. As a result, as shown in FIG. 12, for example, even a small external force applied to the actuator 1 can cause the cam part 4 to move over the steps 3 that form the cam rotation recesses 2 outward of the connector (rightward in FIG. 12), and to be released to the outside of the connector, despite the locking action of the cam lock protrusions 6 provided at one end of the conductive contacts 5.

PRIOR ART LITERATURE

Patent Literature

Patent Literature 1: Japanese Unexamined Patent Publication No. 2008-300373

Patent Literature 2: Japanese Unexamined Patent Publication No. 2008-004404

Patent Literature 3: Japanese Unexamined Patent Publication No. 2008-192408

SUMMARY OF THE INVENTION

Accordingly, an object of the present invention is to provide an electrical connector having a simple structure capable of preventing the cam part from coming out of position when the actuator is in an open position.

To achieve the above object, the present invention provides an electrical connector, including an insulating housing, a conductive contact attached inside the insulating housing, and an actuator having a cam part causing the contact to rotate. The contact has a first and a second contact beams that are a pair of beam-like members opposite each other via a signal transmission medium inserted into the insulating housing. The first contact beam has a cam rotation recess at one end accommodating the cam part rotatably. The second contact beam has a cam lock protrusion at one end facing the cam part in a direction in which the signal transmission medium is inserted. The cam part of the actuator is configured to rotate between a closed position where the first and second contact beams sandwich the signal transmission medium and an open position where the first and second contact beams separate from the signal transmission medium. The electrical connector employs a structure in which the cam part of the actuator is provided with an engaging surface formed by a flat surface facing the cam lock protrusion of the second contact beam in the direction in which the signal transmission medium is inserted when the actuator is in the open position.

In the present invention, the engaging surface should preferably be positioned such as to abut on the cam lock protrusion when the cam part displaces from the cam rotation recess in the direction in which the signal transmission medium is inserted.

According to the present invention having such a structure, upon the cam part trying to come out of the cam rotation recess due to an external force or the like acting to push the cam part outward of the connector when the actuator is in the open position, the engaging surface of the cam part abuts on the cam lock protrusion and makes locking engagement therewith so that the actuator is prevented from coming out of position.

In the present invention, the second contact beam should preferably be provided at one end with a cam restricting edge extending substantially straight from the cam lock protrusion, and the cam part of the actuator should preferably be provided with a holding surface capable of making surface contact with the cam restricting edge of the second contact beam when the actuator is in the open position.

According to the present invention having such a structure, when the actuator in the open position is pushed outward of the connector, the holding surface of the cam part first abuts on the cam restricting edge of the second contact beam so as to keep the cam part pressed against the cam rotation recess, and as the cam part is maintained in the position it is supposed to be, by cooperation with the engaging surface mentioned above, the actuator is prevented more reliably from coming out of position.

As described above, in the electrical connector according to the present invention, the cam part of the actuator for rotating a contact mounted inside the insulating housing is provided with an engaging surface which is a flat surface that faces a cam lock protrusion of the second contact beam when the actuator is in an open position, so that, upon the cam part trying to come out of the cam rotation recess due to an external force or the like acting to push the cam part outward of the connector when the actuator is in the open position, the engaging surface of the cam part abuts on and makes locking engagement with the cam lock protrusion, whereby the actuator is prevented from coming out of position. Thus disengagement of the cam part when the actuator is in the open position is prevented with a simple structure, whereby the quality and reliability of the electrical connector can be significantly improved at low cost.

DESCRIPTION OF THE PREFERRED EMBODIMENTS

Figure 1:
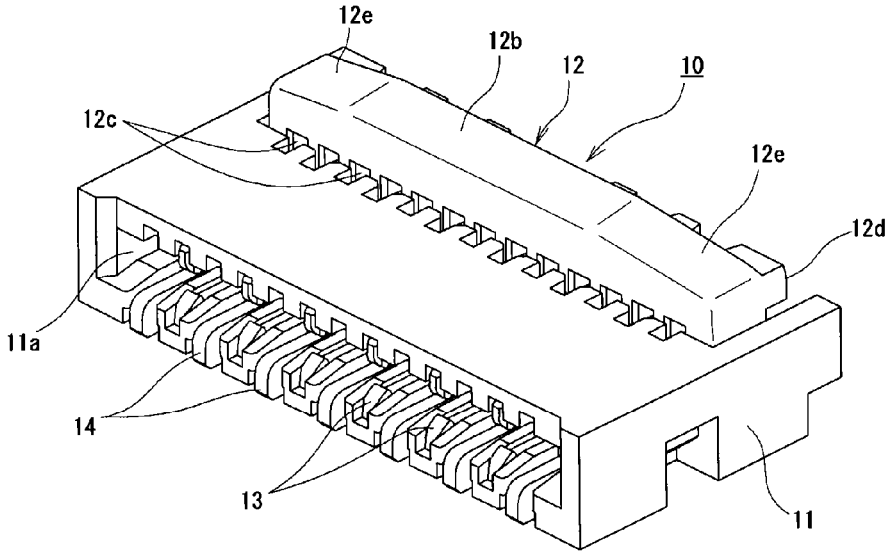
FIG. 1 is an external perspective illustration of an electrical connector according to one embodiment of the present invention, showing the overall structure from the front side when the actuator is upright in an open position and a signal transmission medium has not been inserted yet.
Figure 2:
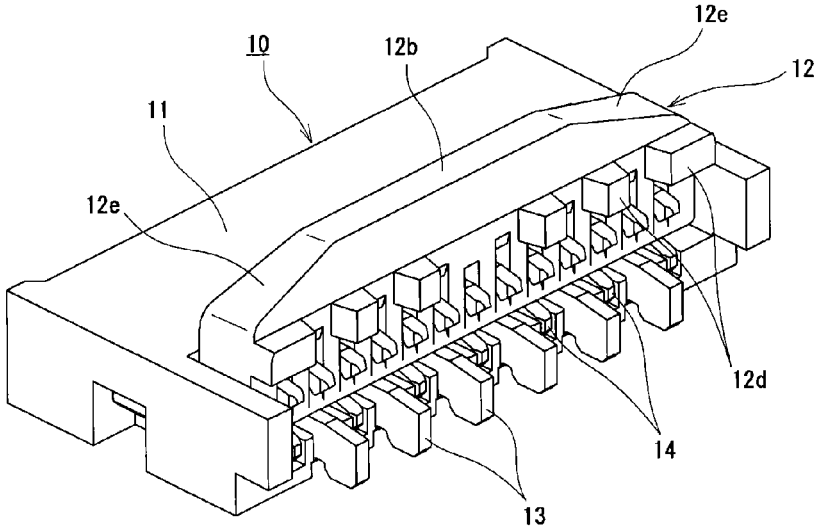
FIG. 2 is an external perspective illustration of the electrical connector in the open position shown in FIG. 1, viewed from the backside.
Figure 3:
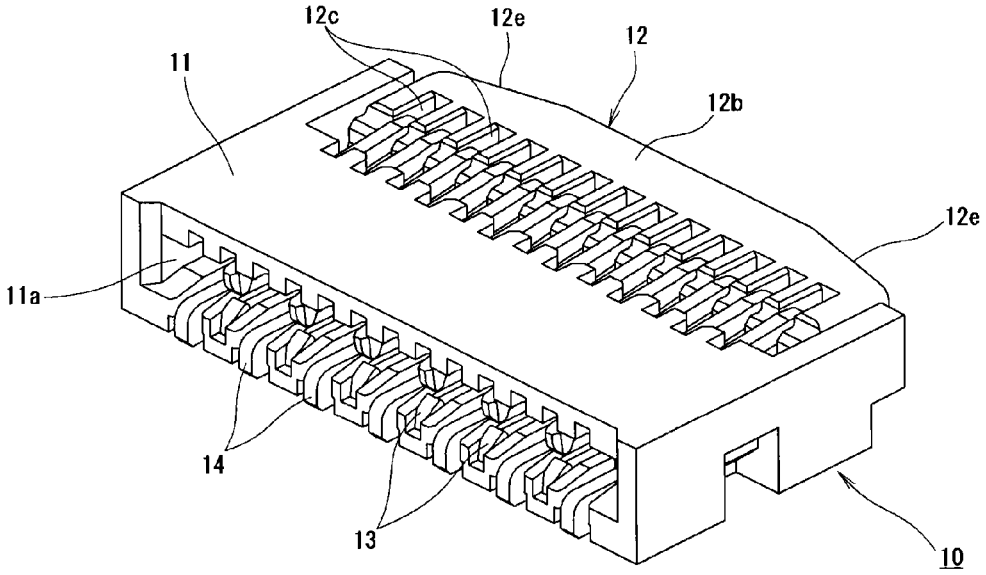
FIG. 3 is an external perspective illustration of the electrical connector, showing the overall structure from the front side when the actuator in the open position shown in FIG. 1 has been pushed down and pivoted to a closed position.
Figure 4:
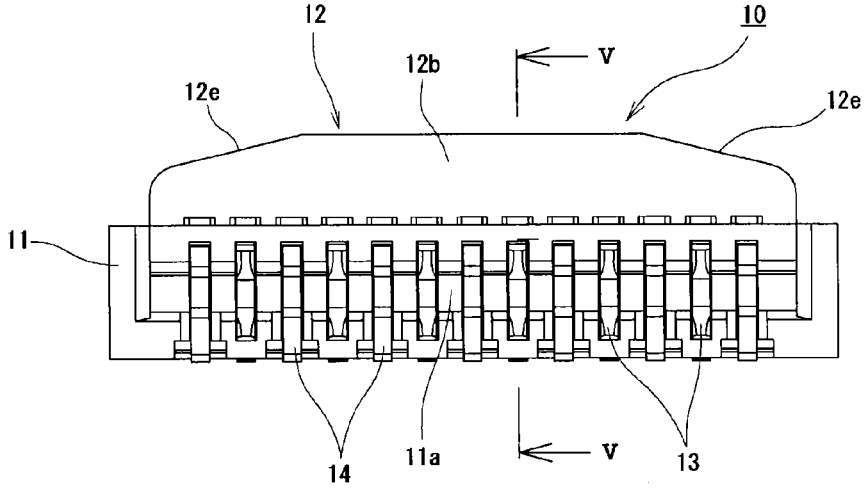
FIG. 4 is a front illustration of the electrical connector in the open position shown in FIG. 1 and FIG. 2, viewed from the front side.

Below, one embodiment of the present invention applied to an electrical connector used as mounted on a wiring board for connecting a signal transmission medium such as a flexible printed circuit (FPC) or a flexible flat cable (FFC) will be described in detail with reference to the drawings.

The electrical connector 10 according to one embodiment of the present invention shown in FIG. 1 to FIG. 11 has a structure known as a back flip type, with an actuator 12 as a connection operator provided in a rear end portion (right end portion in FIG. 5) of an insulating housing 11. The actuator 12 is configured to pivot when pushed down toward the rear side of the connector (right side in FIG. 5) opposite from the front side of the connector (left side in FIG. 5) to which a terminal portion of a signal transmission medium (such as FPC or FFC) F is inserted.

The insulating housing 11 is made of an insulating material and formed in a thin and long, hollow frame-like shape. The longitudinal width direction of this insulating housing 11 shall be hereinafter referred to as "connector longitudinal direction", and a direction in which the terminal portion of the signal transmission medium (such as FPC or FFC) F is inserted or removed shall be referred to as "connector front and back direction".

Inside the insulating housing 11 are mounted a plurality each of two types of conductive contacts 13 and 14 in different shapes that are thin metal parts with specific shape designed as required. These conductive contact 13 and 14 are arranged at suitable intervals along the connector longitudinal direction to form a multipole terminal inside the insulating housing 11. The conductive contacts 13 having one shape and the conductive contacts 14 having a different shape are alternately aligned along the connector longitudinal direction that is the direction of the multipole arrangement. These conductive contacts 13 and 14 are used as mounted on a main printed wiring board (not shown) by being soldered to conductive paths (not shown) formed thereon for signal transmission and for connection to ground, respectively.

A medium insertion hole 11*a* is formed in a slot shape along the connector longitudinal direction at the front end (left end in FIG. 5) of the insulating housing 11, for receiving the terminal portion of the signal transmission medium F such as a flexible printed circuit (FPC) or a flexible flat cable (FFC), as mentioned above. A mounting hole 11*b* for mounting the conductive contacts 13 of one type, the actuator (connection operator) 12, and others is formed similarly in a slot shape at the opposite rear end (right end in FIG. 5) in the connector front and back direction.

Figure 5:
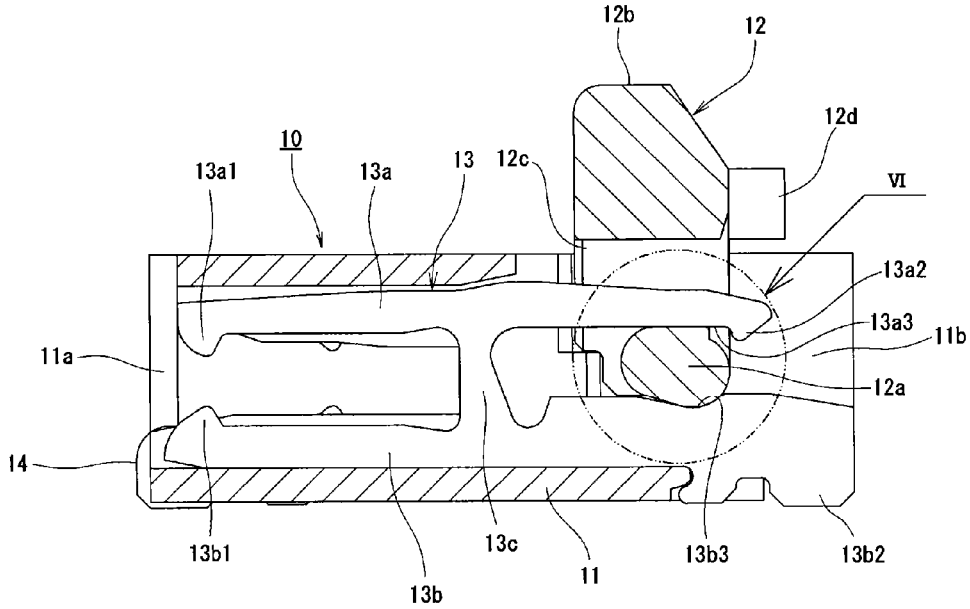
FIG. 5 is a longitudinal cross-sectional illustration along the line V-V in FIG. 4.

While the conductive contacts 13 of one type are mounted by being inserted into the mounting hole 11*b* at the connector rear end of the insulating housing 11 toward the front (left side in FIG. 5), the conductive contacts 14 of the other type are mounted by being inserted into the medium insertion hole 11*a* at the connector front end of the insulating housing 11 toward the back (right side in FIG. 5). The respective conductive contacts 13 and 14 mounted inside the insulating housing 11 in this manner are arranged at positions corresponding to the wiring pattern Fa (see FIG. 11) of the signal transmission medium (such as FPC or FFC) F inserted from the medium insertion hole 11*a* into the insulating housing 11. The wiring pattern Fa formed on the signal transmission medium F consists of signal transmission conductive paths (signal line pads) or shield conductive paths (shield line pads) arranged at suitable intervals.

Although the conductive contacts 13 and 14 have different shapes as mentioned above, they are configured the same in the essential part of the present invention to be described later, and therefore, in the following description, the conductive contacts 13 of one type only will be described, and the conductive contacts 14 of the other type will not be described.

The conductive contacts 13 each have a pair of thin long beam members, a movable contact beam (second contact beam) 13*a* and a stationary contact beam (first contact beam) 13*b*, extending substantially parallel to each other along the front and back direction that is the direction in which the signal transmission medium F is inserted and removed (left and right direction in FIG. 5). These movable contact beam 13*a* and stationary contact beam 13*b* are disposed opposite and spaced a suitable distance from each other in the up and down direction of the drawing in the inner space of the insulating housing 11. The stationary contact beam 13*b* is secured along the inner wall surface of the bottom plate of the insulating housing 11 so as to be substantially unmovable. The movable contact beam 13*a* extending substantially parallel to the stationary contact beam 13*b* at an upper position in the drawing is integrally coupled to the stationary contact beam 13*b* via a coupling support beam 13*c*.

The coupling support beam 13*c* is a strip of plate member arranged to extend in the up and down direction of the drawing substantially at the center in the extending direction of both contact beams 13*a* and 13*b*. The movable contact beam 13*a* coupled to the upper end in the drawing of this coupling support beam 13*c* is allowed to move resiliently relative to the stationary contact beam 13*b* by the resiliency and flexibility of the coupling support beam 13*c*, i.e., each movable contact beam 13*a* is configured to be able to rotate about the coupling support beam 13*c* or its vicinity as the rotation center. The rotation of the movable contact beam 13*a* takes place in the up and down direction in the paper plane of FIG. 5.

The movable contact beam (second contact beam) 13*a* has an upper terminal contact protrusion 13*a*1 protruding downward in the drawing at the front end (left end in FIG. 5), which will be connected to the wiring pattern (one of the signal transmission or shield conductive paths) Fa formed on the upper side in the drawing of the signal transmission medium (such as FPC or FFC) F.

The stationary contact beam (first contact beam) 13*b* is arranged to extend in the front and back direction along the inner wall surface of the bottom plate of the insulating housing 11 as mentioned above. The stationary beams 13*b* each have a lower terminal contact protrusion 13*b*1 protruding upward in the drawing at the front end (left end in FIG. 5), which will be connected to the wiring pattern (one of the signal transmission or shield conductive paths not shown) Fa formed on the lower side in the drawing of the signal transmission medium (such as FPC or FFC) F. These lower terminal contact protrusions 13*b*1 are arranged to face the upper terminal contact protrusions 13*a*1 of the movable contact beam 13*a* side directly therebelow in the drawing, so that these upper and lower terminal contact protrusions 13*a*1 and 13*b*1 sandwich the signal transmission medium F.

The upper terminal contact protrusion 13*a*1 of the movable contact beam 13*a* and the lower terminal contact protrusion 13*b*1 of the stationary contact beam 13*b* may be disposed at positions offset from each other in the front and back direction (left side or right side in FIG. 5). While the stationary contact beam 13*b* is basically secured to be unmovable, it may be formed such that its front end can move resiliently so that the signal transmission medium (such as FPC or FFC) F can be inserted easily or for other purposes. Alternatively, the stationary contact beam 13*b* may be formed to have a front end slightly lifted up from the inner wall surface of the bottom plate of the insulating housing 11.

Further, the stationary contact beams 13*b* each have a board connecting portion 13*b*2 soldered to the conductive paths formed on the main printed wiring board (not shown) at the rear end (right end in FIG. 5).

Moreover, the stationary contact beam 13*b* is formed with a cam rotation recess 13*b*3 that is a curved indentation in a rear end (right end in FIG. 5). The movable contact beam 13*a* has a cam lock protrusion 13*a*2 protruding downward in the drawing at the rear end (right end in FIG. 5). An open/close cam 12*a* of the actuator (connection operator) 12 that is mounted to the rear end of the insulating housing 11 is disposed between and in contact with these cam rotation recess 13*b*3 and the cam lock protrusion 13*a*2.

The open/close cam 12*a* of the actuator (connection operator) 12 has a substantially elliptical longitudinal cross-sectional shape, with a pair of cam surfaces 12*a*1, 12*a*1 at both ends of the major axis of the ellipse. These cam surfaces 12*a*1 have a curved shape substantially conforming to the cam rotation recesses 13*b*3 of the stationary contact beams 13*b*. One of the cam surfaces 12*a*1, 12*a*1 (lower one in FIG. 6) is rotatably accommodated in the cam rotation recesses 13*b*3 of the stationary contact beams 13*b*.

The other one of the cam surfaces 12*a*1, 12*a*1 (upper one in FIG. 6) is in slidable contact with a rear end portion of the movable contact beams 13*a*. Namely, the cam surface 12*a*1 of the open/close cam 12*a* is in slidable contact with a cam restricting edge 13*a*3 extending substantially straight from the cam lock protrusion 13*a*2 in a rear end portion of the movable contact beam 13*a* and forming the lower edge of the movable contact beam 13*a*. With the open/close cam 12*a* making contact with, and being arranged relative to, the cam rotation recesses 13*b*3 and the cam restricting edges 13*a*3 in this manner, the open/close cam 12*a* is rotatably supported, so that the entire actuator 12 can pivot around the rotation center of the open/close cam 12*a*.

Figure 7:
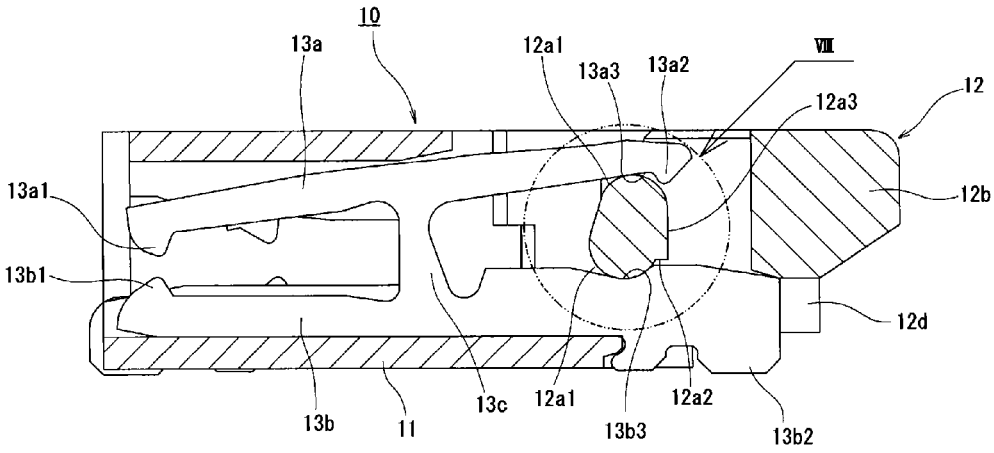
FIG. 7 is a longitudinal cross-sectional illustration of the electrical connector corresponding to FIG. 5, when the actuator in the open position has been pushed down and pivoted to the closed position.
Figure 8:
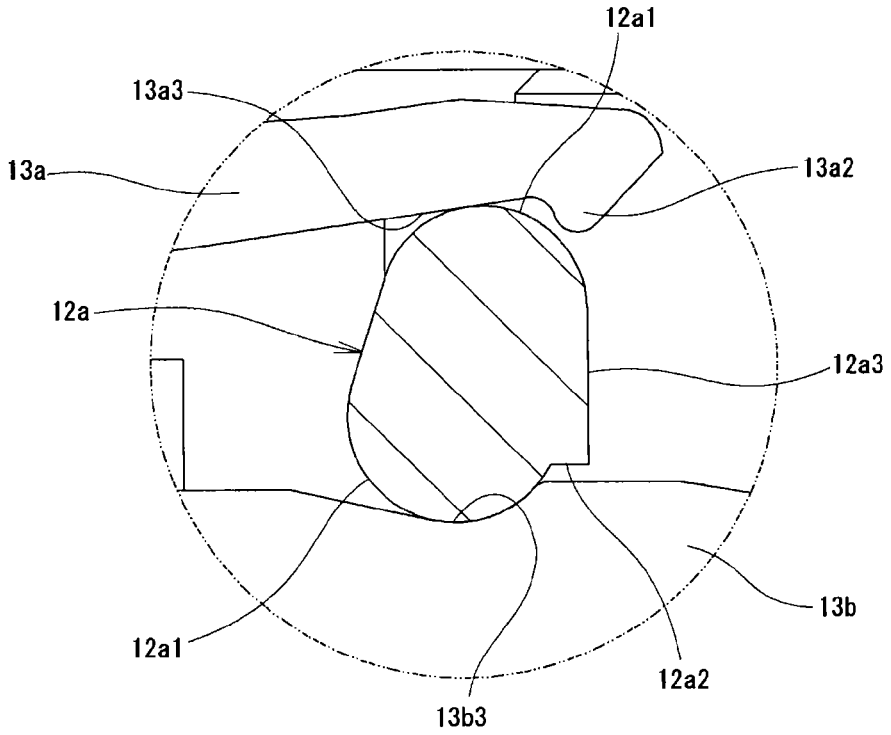
FIG. 8 is a partial longitudinal cross-sectional illustration showing part VIII in FIG. 7 to a larger scale.

The actuator (connection operator) 12 pivotally disposed at the rear end (right end in FIG. 5 and FIG. 7) of the insulating housing 11 has a thin and long shape as a whole and extends along the connector longitudinal direction substantially over the entire width of the insulating housing 11. This actuator 12 is attached to pivot around the rotation center of the open/close cam 12*a* as mentioned above. A portion on the outer side of the rotation radius (right end portion in FIG. 7) forms an open/close operating part 12*b*. With a suitable force being applied by an operator to this open/close operating part 12*b*, the entire actuator 12 is reciprocally pivoted between an "open position" where it is substantially upright as shown in FIG. 5 and a "closed position" where it lies substantially horizontally toward the rear side of the connector as shown in FIG. 7.

Slit-like through holes 12*c* are formed in portions where the open/close operating part 12*b* is connected to the open/close cam 12*a* to avoid contact with the conductive contacts 13 (14). When the actuator 12 is pivoted to the "open position" (see FIG. 5), the rear ends of the movable contact beams 13*a* of the conductive contacts 13 enter into these slit-like through holes 12*c*.

Upon the operator pushing down the open/close operating part 12*b* of the actuator (connection operator) 12 to pivot it from the "open position" (see FIG. 5) toward the "closed position" (see FIG. 7), the radius of rotation of the open/close cam 12*a* increases between the stationary contact beams 13*b* and the movable contact beams 13*a*. In accordance with this increase in the diameter of the open/close cam 12*a*, the cam restricting edges 13*a*3 formed at the rear ends of the movable contact beams 13*a* move up in the drawing, while the upper terminal contact protrusions 13*a*1 formed on the opposite side (connector front side) of the cam restricting edges 13*a*3 are pushed down.

Figure 11:
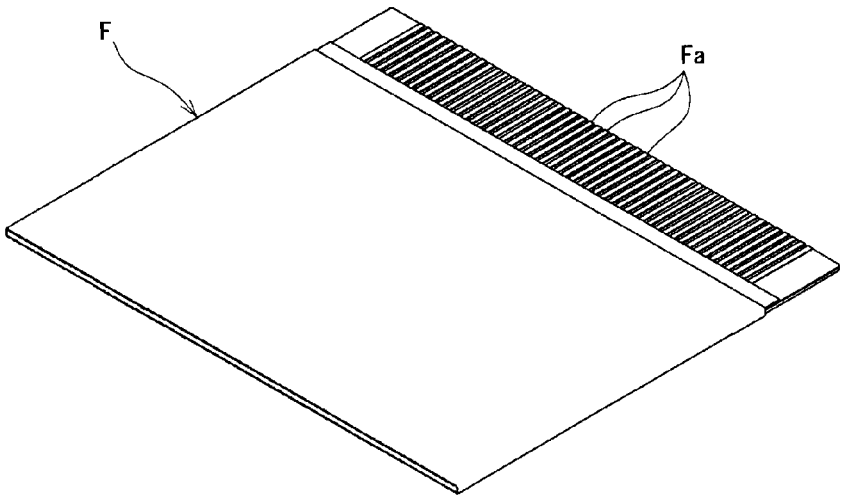
FIG. 11 is an external perspective illustration showing a terminal portion of the signal transmission medium to be inserted into the electrical connector shown in FIG. 1 to FIG. 10.
Figure 12:
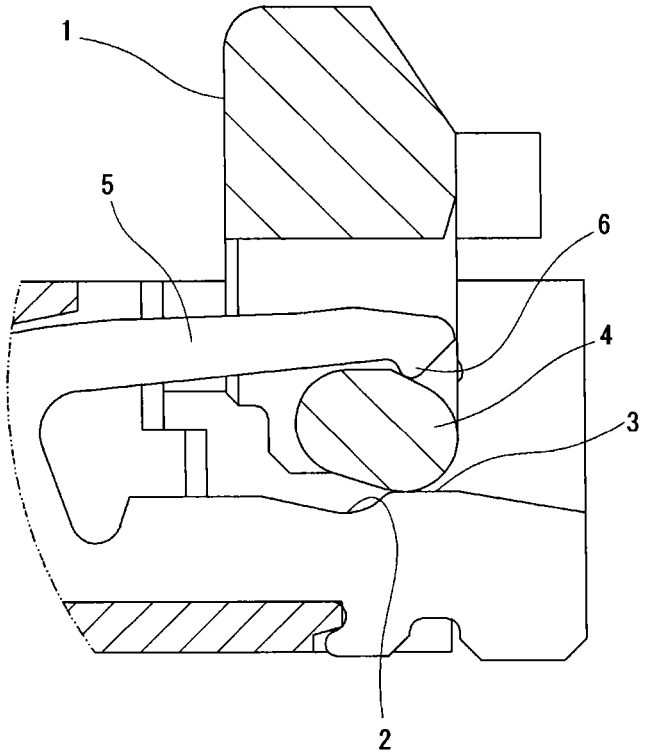
FIG. 12 is a partial longitudinal cross-sectional illustration showing the structure of a cam part in a conventional electrical connector to a larger scale.

Consequently, when the actuator (connection operator) 12 has pivoted completely to the "closed position" which is the rotation end (see FIG. 7), the upper terminal contact protrusions 13*a*1 of the movable contact beams 13*a* and the lower terminal contact protrusions 13*b*1 of the stationary contact beams 13*b* make pressure contact from above and below and sandwich the signal transmission medium (such as FPC or FFC) F inserted between them. In particular, the upper terminal contact protrusions 13*a*1 and the lower terminal contact protrusions 13*b*1 make pressure contact with the wiring pattern (signal transmission or shield conductive paths) Fa of the signal transmission medium F as shown in FIG. 11, whereby electrical connection is established.

When the actuator 12 has been pushed down rearward to pivot from the "open position" (see FIG. 5) to the "closed position" (see FIG. 7), the lower side in the drawing of the open/close operating part 12*b* of the actuator 12 comes close to and faces the main wiring board (not shown). The open/close operating part 12*b* is formed with protection protrusions 12*d* on the lower side, protruding toward the main wiring board in this state. A plurality of such protection protrusions 12*d*, each formed as a substantially quadrangular prismatic block member, are disposed at predetermined intervals in the direction of the multipole arrangement of the conductive contacts 13 and 14 (connector longitudinal direction) so that they are integrally moved with the actuator 12 being pivoted.

The actuator 12 further includes inclined surfaces 12*e*, 12*e* continuously formed at both ends in the connector longitudinal direction of the open/close operating part 12*b* such as to gradually slope down from the main operating part in the center.

The cam lock protrusions 13*a*2 of the movable contact beams 13*a* come to a position separated a certain distance rearward from the open/close cam 12*a* of the actuator 12 when the actuator 12 is in the "open position" (see FIG. 5 and FIG. 6), where they face the open/close cam 12*a* in the direction in which the signal transmission medium F is inserted. When the actuator 12 is pivoted to the "closed position" (see FIG. 7 and FIG. 8), the open/close cam 12*a* stands upright vertically so that the cam surface 12*a*1 on the upper side (upper side in FIG. 7) of the vertically upright open/close cam 12*a* comes close to and opposite the cam lock protrusions 13*a*2. Therefore, when an external force is applied to the actuator 12 located in this "closed position" rearward (rightward in FIG. 7) so that the open/close cam 12*a* tries to shift rearward, the cam surface 12*a*1 of the actuator 12 abuts on the cam lock protrusions 13*a*2 and thereby prevents the actuator 12 from coming out of position rearward.

Figure 6:
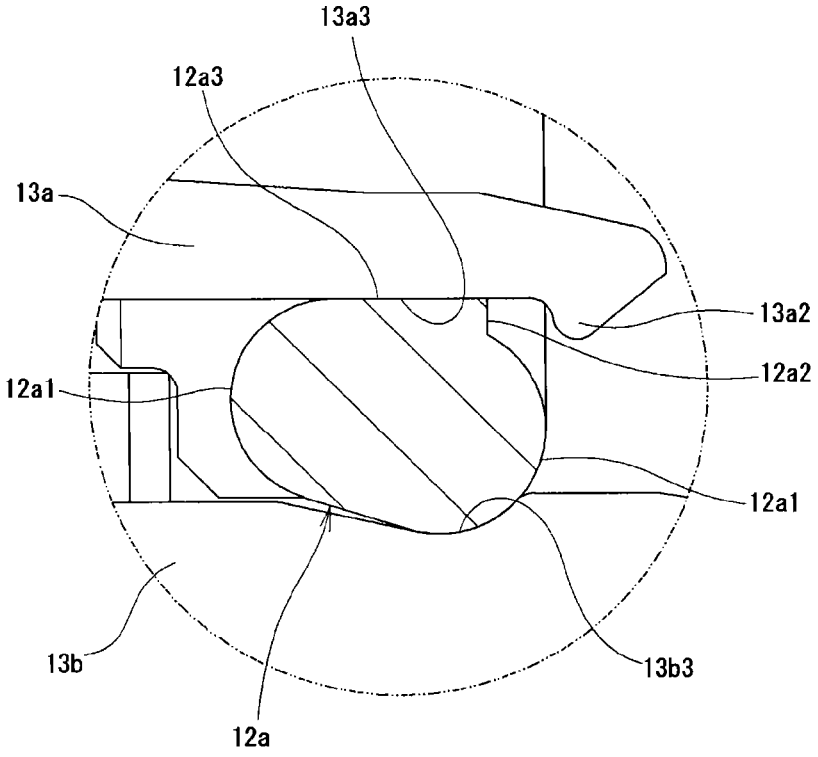
FIG. 6 is a partial longitudinal cross-sectional illustration showing part VI in FIG. 5 to a larger scale.

In this embodiment, further, the following configuration is adopted as a means of preventing disengagement of the actuator 12 when the actuator 12 is in the "open position" (see FIG. 5 and FIG. 6).

Namely, the open/close cam 12*a* of the actuator 12 is formed on the outer circumferential surface thereof with an engaging surface 12*a*2 and a holding surface 12*a*3 in a portion between the pair of cam surfaces 12*a*1, 12*a*1. These engaging surface 12*a*2 and holding surface 12*a*3 are provided in the upper half of the open/close cam 12*a* when the actuator 12 is in the "open position" (see FIG. 5 and FIG. 6). The holding surface 12*a*3 is a flat surface extending substantially horizontally opposite the cam restricting edge 13*a*3 of the movable contact beam 13*a*. When the actuator 12 is in the "open position" (see FIG. 5 and FIG. 6), the holding surface 12*a*3 of the open/close cam 12*a* makes surface contact with the cam restricting edges 13*a*3 of the movable contact beams 13*a* from below, whereby the open/close cam 12*a* can act to keep the actuator 12 in the open state.

On the other hand, the engaging surface 12*a*2 provided on the open/close cam 12*a* is a flat surface bent substantially at right angles from the rear end (right end in FIG. 5) of the holding surface 12*a*3, when the actuator 12 is similarly in the "open position" (see FIG. 5 and FIG. 6), facing the cam lock protrusions 13*a*2 of the movable contact beams 13*a* from the front side in the direction in which the signal transmission medium F is inserted.

Figure 9:
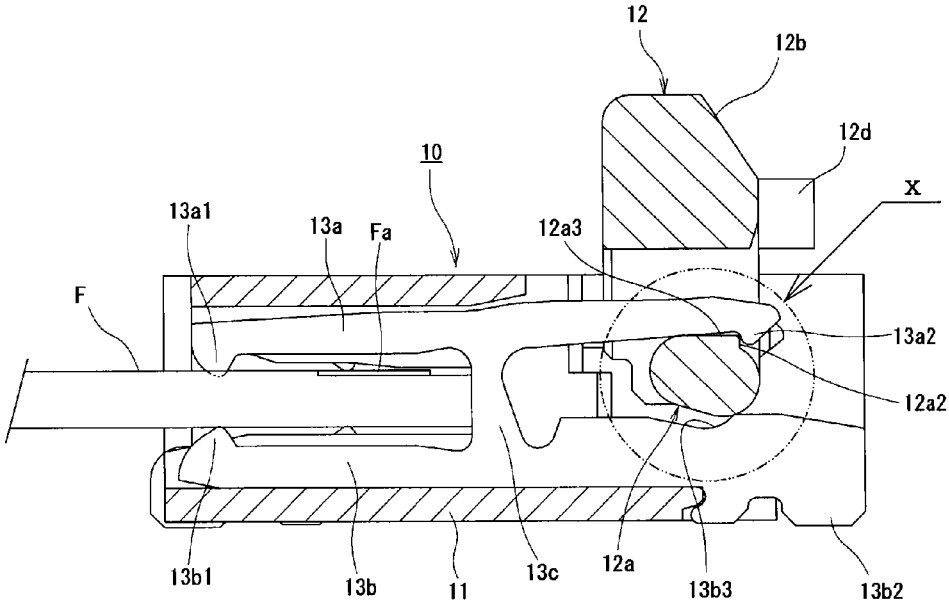
FIG. 9 is a longitudinal cross-sectional illustration corresponding to FIG. 5, when a rearward external force is applied to the actuator of the electrical connector in the open position.
Figure 10:
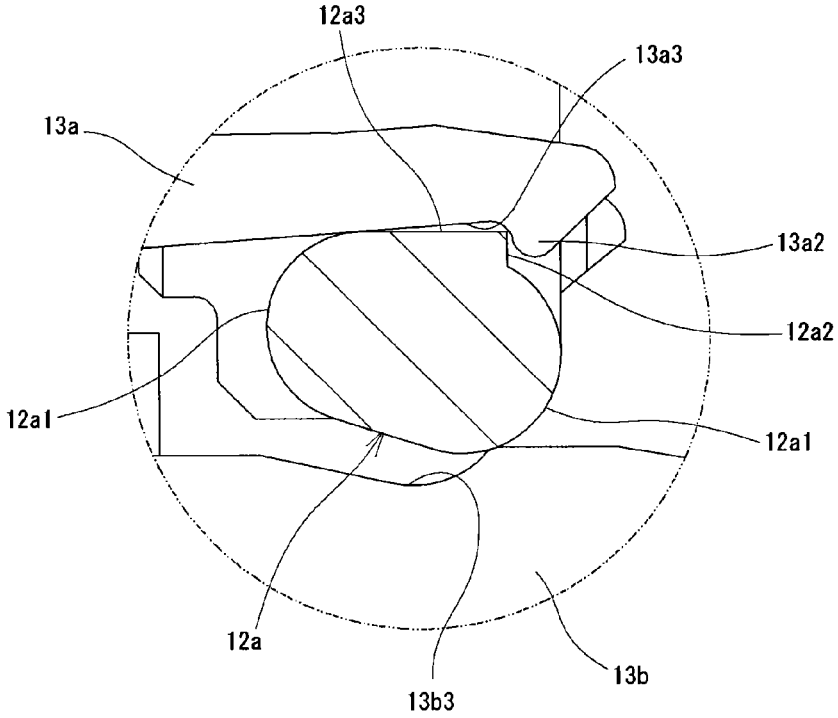
FIG. 10 is a partial longitudinal cross-sectional illustration showing part X in FIG. 9 to a larger scale.

When an external force is applied rearward (rightward in FIG. 5) to the actuator 12 when it is in the "open position", the cam surface 12*a*1 of the open/close cam 12*a* displaces rearward from the position at which it is accommodated in the cam rotation recesses 13*b*3 of the stationary contact beams 13*b*, as shown in FIG. 9, and tries to move onto the upper edges of the stationary contact beams 13*b* which form a step to the rear of the cam rotation recesses 13*b*3. Namely, the open/close cam 12*a* tries to displace diagonally upward to the back. With this displacement of the open/close cam 12*a*, the engaging surface 12*a*2 of the actuator 12 moves up and makes pressure contact with the cam lock protrusions 13*a*2 of the movable contact beams 13*a* as shown in FIG. 9 and FIG. 10. As a result, with the cam lock protrusions 13*a*2 locking the engaging surface 12*a*2, the actuator 12 is prevented from coming out of position rearward.

When the actuator 12 is in the "closed position" (see FIG. 7 and FIG. 8), the engaging surface 12*a*2 of the open/close cam 12*a* is located to face the upper edges of the stationary contact beams 13*b* from above. When the actuator 12 tries to pivot excessively further than the "closed position", the engaging surface 12*a*2 of the open/close cam 12*a* abuts on the upper edges of the stationary contact beams 13*b*, together with the open/close operating part 12*b*, and thus excessive pivoting of the actuator 12 is prevented by the stopper function of these components.

As described above, in this embodiment, upon the open/close cam 12*a* trying to come out of the cam rotation recesses 13*b*3 due to an external force or the like acting to push the open/close cam 12*a* outward of the connector when the actuator 12 is in the "open position", the engaging surface 12*a*2 of the open/close cam 12*a* abuts on the cam lock protrusions 13*a*2 of the movable contact beams 13*a* and makes locking engagement therewith so that the actuator 12 is prevented from coming out of position.

In this embodiment, in particular, when the actuator 12 is pushed outward, the holding surface 12*a*3 of the open/close cam 12*a* first abuts on the cam restricting edges 13*a*3 formed in the rear ends of the movable contact beams 13*a* so as to keep the open/close cam 12*a* pressed against the cam rotation recesses 13*b*3. As the open/close cam 12*a* is maintained in the position it is supposed to be, by cooperation with the engaging surface 12*a*2 of the open/close cam 12*a*, the actuator 12 is prevented more reliably from coming out of position.

The open/close operating part 12*b* of the actuator 12 is in an elongated shape extending along the connector longitudinal direction as mentioned above. The end face on the operating side located on the outer side in the radial direction of the rotation center of the open/close operating part 12*b*, i.e., the upper end face of the actuator 12 when it is upright in the "open position" (see FIG. 4 and FIG. 5), includes the inclined surfaces 12*e*, 12*e* at both ends in the connector longitudinal direction. These inclined surfaces 12*e*, 12*e* are formed to slope down outwardly in the connector longitudinal direction in which the actuator 12 extends, at a suitable angle relative to the connector longitudinal direction. Between these inclined surfaces 12*e*, 12*e* is formed a flat surface in an elongated shape extending along the connector longitudinal direction in which the actuator 12 extends.

The inclined surfaces 12*e*, 12*e* provided at both ends in the connector longitudinal direction are formed to be smoothly continuous with both ends of the flat surface provided in the center of the connector longitudinal direction, without any pointed edges at the boundaries between these surfaces. When the actuator 12 is pivoted from the "open position" to the "closed position", the upright wall surface on the front side, which is the front end face (left end face in FIG. 5), of the upright actuator 12 in the "open position" (see FIG. 5), is pressed rearward by fingertips of the operator. With the inclined surfaces 12*e* provided at both ends of the open/close operating part 12*b* of the actuator 12 as described above, the pressure exerted by the operator acts less on the portions at both ends in the longitudinal direction where the inclined surfaces 12*e* are provided, and tends to act more on the central portion in the longitudinal direction of the actuator 12.

The pressure applied to the inclined surfaces 12*e* at both ends in the longitudinal direction of the actuator 12 acts in a direction substantially orthogonal to the slopes forming the inclined surfaces 12*e*, i.e., from both ends in the longitudinal direction of the actuator 12 toward the center. The pressure the operator applies, therefore, acts on the whole substantially uniformly over the entire length of the actuator 12, so that the actuator 12 is unlikely to be pressed in a twisted state as was the case with the conventional connector. As the actuator 12 is kept substantially flat and pivoted entirely, the signal transmission medium (such as FPC of FFC) F is sandwiched favorably by the pivoting of the actuator 12.

While the invention made by the present inventor has been described in specific terms based on the embodiments, it should be understood that the present invention is not limited to the embodiments described above and can be variously modified without departing from the scope of its subject matter.

For example, while a flexible printed circuit (FPC) or a flexible flat cable (FFC) is adopted as the signal transmission medium secured to the electrical connector in the embodiment described above, the present invention can be similarly applied to a connector using other types of signal transmission media.

While the actuator according to the embodiment described above is disposed at the rear end of the insulating housing, the present invention can be similarly applied to an electrical connector having an actuator in a front end, or an electrical connector having an actuator between the front end and rear end.

While the electrical connector according to the embodiment described above uses conductive contacts of different shapes, the present invention can be similarly applied to a connector using conductive contacts of the same shape.

The present invention can be widely applied to a variety of electrical connectors used in various electrical devices.

What is claimed is:

1. An electrical connector, comprising an insulating housing, a conductive contact attached inside the insulating housing, and an actuator having a cam part causing the contact to rotate, the contact having a first and a second contact beams that are a pair of beam-like members opposite each other via a signal transmission medium inserted into the insulating housing, the first contact beam having a cam rotation recess at one end accommodating the cam part rotatably, the second contact beam having a cam lock protrusion at one end facing the cam part in a direction in which the signal transmission medium is inserted, and the cam part of the actuator being configured to rotate between a closed position where the first and second contact beams sandwich the signal transmission medium and an open position where the first and second contact beams separate from the signal transmission medium, wherein the cam part of the actuator is provided with an engaging surface formed by a flat surface facing the cam lock protrusion of the second contact beam in the direction in which the signal transmission medium is inserted when the actuator is in the open position.

2. The electrical connector according to claim 1, wherein the engaging surface is positioned so as to abut on the cam lock protrusion when the cam part displaces from the cam rotation recess in the direction in which the signal transmission medium is inserted.

3. The electrical connector according to claim 1, wherein the second contact beam is provided at one end with a cam restricting edge extending substantially straight from the cam lock protrusion, and the cam part of the actuator is provided with a holding surface capable of making surface contact with the cam restricting edge of the second contact beam when the actuator is in the open position.

* * * * *